US005401204A

United States Patent [19]

Shank

[11] Patent Number: 5,401,204

[45] Date of Patent: Mar. 28, 1995

[54] BLAST NOZZLE CONTAINING WATER ATOMIZER FOR DUST CONTROL

[75] Inventor: James D. Shank, Vestal, N.Y.

[73] Assignee: Church & Dwight Co., Inc., Princeton, N.J.

[21] Appl. No.: 209,545

[22] Filed: Mar. 10, 1994

Related U.S. Application Data

[62] Division of Ser. No. 958,552, Oct. 8, 1992, Pat. No. 5,319,894.

[51] Int. Cl.[6] ..... B24C 7/00; B24C 11/00

[52] U.S. Cl. ..... 451/40; 451/39

[58] Field of Search ..... 51/319, 320, 321, 439, 51/427, 410, 436, 438, 428; 451/38, 39, 40, 102, 90, 75, 99, 101, 91

[56] References Cited

U.S. PATENT DOCUMENTS

| | | | |
|---|---|---|---|
| 2,324,250 | 7/1943 | Voerge | 51/439 |
| 2,376,287 | 5/1945 | Sorrentino | 51/439 |
| 2,543,517 | 2/1951 | Anderson | 51/439 |
| 2,644,275 | 7/1953 | Hoguet | 51/439 |
| 2,669,809 | 2/1954 | McGrath | 51/439 |
| 4,878,320 | 11/1989 | Woodson | 51/320 |

*Primary Examiner*—Robert A. Rose
*Attorney, Agent, or Firm*—Charles B. Barris

[57] ABSTRACT

A blast nozzle for directing a stream of abrasive particles against a surface to remove surface contaminants therefrom further includes an externally attached atomized water nozzle which directs a stream of atomized water particles to the surface to suppress dust formation.

12 Claims, 4 Drawing Sheets

BLAST NOZZLE CONTAINING WATER ATOMIZER FOR DUST CONTROL

This is a Divisional application of U.S. Ser. No. 07/958,552, filed Oct. 8, 1992, now U.S. Pat. No. 5,319,894.

BACKGROUND OF THE INVENTION

1. Field of the Invention

The present invention relates generally to blast nozzles and a process for removing adherent material such as paint, scale, dirt, grease and the like from solid surfaces with abrasive particles propelled by air. In particular, the present invention is directed to a novel blast nozzle having a water atomizer means useful to control the dust caused by blasting with an abrasive and friable media such as sand or sodium bicarbonate.

2. Description of the Prior Art

In order to clean a solid surface so that such surface can again be coated such as, for example, to preserve metal against deterioration, or simply to degrease a solid surface such as surfaces contacting food or building structures which contain food serving or food processing operations, it has become common practice to use an abrasive blasting technique wherein abrasive particles are propelled by a high pressure fluid against the solid surface in order to dislodge previously applied coatings, scale, dirt, grease or other contaminants. Various abrasive blasting techniques have been utilized to remove the coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 3,000 psi and above, multi-step processes comprising dry or wet blasting and a mechanical technique such as sanding, chipping, etc. and a single step process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used. Water for dust control has been mixed with the air either internally in the blast nozzle or at the targeted surface to be cleaned and such latter process, although primarily a dry blasting technique, is considered wet blasting inasmuch as media recovery and clean up is substantially different from that utilized in a purely dry blasting operation.

A typical dry blasting apparatus as well as a wet blasting apparatus which utilizes highly pressurized air to entrain, carry and direct the abrasive blast media to the solid surface to be treated and low pressure water for dust control comprises a dispensing portion in which the blast media typically contained in a storage tank is entrained in highly pressurized air, a flexible hose which carries the air/blast media mixture to the blast nozzle and which allows the operator to move the blast nozzle relative to the surface to be cleaned and the blast nozzle which accelerates the abrasive blast media and directs same into contact with the surface to be treated. Water is added either internally in the blast nozzle and mixed with the air stream passing therethrough or a low pressure stream of water is provided externally of the blast nozzle and directed at the surface to be treated so as to control dust. The blast nozzle is typically hand-held by the operator and moved relative to the targeted surface so as to direct the abrasive blast media across the entire surface to be treated.

The blast media or abrasive particles most widely used for blasting surfaces to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to non-soluble blast media such as sand, in particular, for removing adherent coatings from relatively soft substrates such as softer metals as aluminum, composite surfaces, plastics, concrete and the like is sodium bicarbonate. While sodium bicarbonate is softer than sand, it is sufficiently hard to remove coatings from aluminum surfaces and as well remove other coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Unfortunately, sodium bicarbonate, typically used as particles having average diameters of from about 50 to 1,000 microns, is even more friable than sand and breaks into smaller particles as it traverses the flexible supply hose which carries the blast media and pressurized air to the blast nozzle and, as well, breaks into pieces as the blast media comes into contact with the internal surfaces of the blast nozzle prior to being propelled to the target surface. As the sodium bicarbonate media contacts the surface to be treated, even smaller particles are formed yielding a substantial amount of dust which invades the targeted area and closely surrounding environment, hindering the operator's vision of the targeted surface. Accordingly, it has become necessary to control the dust which is formed upon blasting with the very friable sodium bicarbonate blast media.

As expressed above, it is possible to control dust by injecting a low pressure stream of water into the air stream which propels the blast media. This has been accomplished by two distinct methods. In one method, the blast nozzle is provided with a water port in which water is injected into the blast nozzle to mix with the air stream and entrained blast media particles. This method has been very effective in controlling the dust of the sodium bicarbonate particles subsequent to contacting the targeted surface. Unfortunately, in view of the low density of the sodium bicarbonate particles and the water solubility thereof, the velocity of the media particles is reduced by the water and consequently, the productivity with respect to cleaning the targeted surface is substantially decreased by this method. Thus, defining performance of a blast nozzle as a rate in which a volume of coating is removed per time, injecting the water with the air stream which propels the blast media has greatly reduced the production rate for the reasons expressed above. An alternative method has been to direct the low pressure water stream externally from the blast nozzle at the targeted surface to control the dust which forms at the contact point. While this process has yielded improved productivity relative to the internally directed water stream, dust control is only slightly improved relative to dry blasting and substantially inferior to the process in which the water stream is directed internally in the blast nozzle. In view of the advantages of utilizing sodium bicarbonate as a blast media as enumerated above, including water solubility to improve clean up, less harmful to the environment and useful to clean a wide variety of different surface types, it certainly would be most advantageous to improve the processes and apparatus for using same. In particular, it would be most advantageous to reduce the dust associated with the sodium bicarbonate blast media and, at the same time, maintain the productivity found using sodium bicarbonate as a blast media in dry blasting.

Accordingly, an object of the present invention is to provide a blast nozzle which can provide good dust control when utilizing a friable blast media to clean a targeted surface.

Another object of the present invention is to provide a blast nozzle which is useful in directing an abrasive but friable blast media against a targeted surface for the cleaning thereof without yielding excessive dust and, at the same time, maintaining the productivity of the nozzle at high levels.

Still another object of the present invention is to provide a blast nozzle useful in directing sodium bicarbonate in a stream of air against a targeted surface for the cleaning thereof and capable of controlling the dust which results when the sodium bicarbonate blast media contacts the targeted surface.

Still yet another object of the present invention is to provide a process for cleaning a surface with sodium bicarbonate which is directed at the surface in a pressurized air stream and control the dust which is formed as the sodium bicarbonate blast media contacts the targeted surface and, at the same time, maintain good productivity for cleaning the surface.

SUMMARY OF THE INVENTION

In accordance with the present invention, a blast nozzle for directing an abrasive media against a targeted surface in a pressurized air stream for the removal of surface coatings, scale, dirt, grease, etc. is provided with an external source of atomized water which is also directed at the targeted surface so as to control the formation of dust. The atomized water is achieved by an atomization nozzle in which air and water are mixed and directed from the nozzle in drops having a diameter of about 200 microns or less. The atomized water is directed at the targeted surface at a location to meet deflected abrasive media particles which have contacted the targeted surface and coalesces or otherwise precipitates the minute particles of blast media, thus greatly reducing the dust which is formed. At the same time, the minute atomized water particles provided at low pressure and externally from the blast nozzle do not substantially interfere with the media flow from the blast nozzle to the targeted surface and, thus, maximum velocity of the blast media is substantially maintained and productivity for stripping or cleaning the targeted surface is maintained at high levels, approaching those levels achieved for purely dry blasting operations.

DETAILED DESCRIPTION OF THE INVENTION

Figure 1:
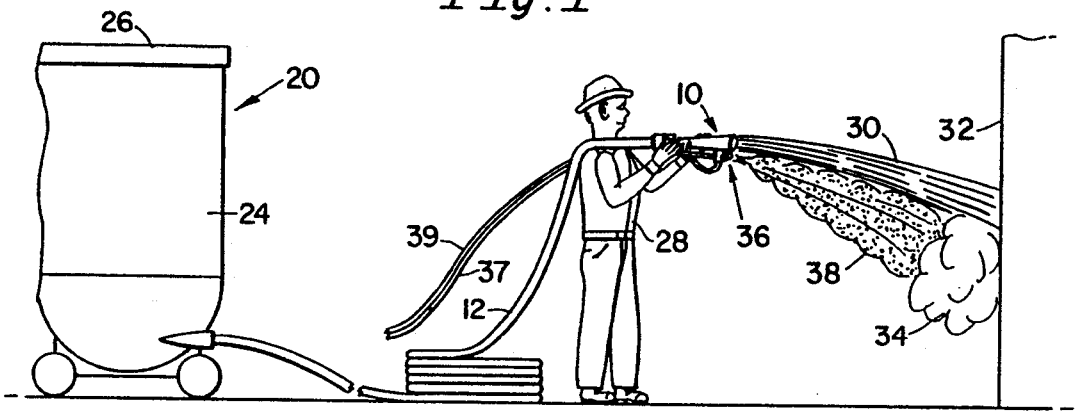
FIG. 1 is a schematic representation of the blast cleaning system of the present invention and operation thereof.

Referring initially to FIG. 1, a typical air-propelled abrasive blast system includes a blast nozzle 10 that is connected to the outer end of a high pressure flexible supply hose 12 which carries the blast media mixed with air from dispensing device 20 to the inlet of blast nozzle 10. A normally closed "deadman" control valve 22 (FIG. 3) is mounted adjacent the blast nozzle 10 and functions to prevent operation of the blast nozzle unless the control valve is held open by depressing a spring-loaded lever.

Dispensing device 20 generally includes a supply of abrasive particles 24, such as sand or, more particularly, sodium bicarbonate, contained in a tank or pot 26 which is sized to hold a selected quantity of abrasive. Compressed air applied to tank 26 carries the blast media to supply hose 12. The flow of abrasive blast media from tank 26 through supply hose 12 is typically controlled via a metering and shut-off valve (shown in FIG. 5). The supply hose 12 extends from the tank 26 and typically is passed over the shoulder of the operator designated by reference numeral 28 and is connected to blast nozzle 10. There are various means to meter the abrasive blast media into the compressed air stream and any of such metering devices are operable in the present invention. A particularly preferred metering device utilizes differential air pressure and is described in commonly assigned U.S. Pat. Nos. 5,081,799 and 5,083,402 herein incorporated by reference and illustrated in FIG. 5 which is discussed below.

As shown in FIG. 1, exiting blast nozzle 10 is a stream of abrasive blast particles entrained in a pressurized air stream indicated by reference numeral 30 which contacts surface 32. As the abrasive blast particles contact surface 32, these particles strip the coating, dirt, etc. from the surface and along with this stripped material are deflected from surface 32 in a direction opposite to the direction of the stream issuing from the blast nozzle. The abrasive blast media which is often very friable, such as sodium bicarbonate, breaks into smaller pieces as it contacts surface 32 and forms a dust cloud 34 as the particles are deflected from the surface 32. In accordance with the present invention, blast nozzle 10 further includes a water atomizer nozzle 36 which directs a spray of atomized water 38 at this cloud of dust to coalesce the dust particles and cause such particles to precipitate to the ground to suppress the formation of dust cloud 34 and prevent the dispersion of the dust particles away from the surface 32 and into the surrounding environment. Pressurized water and air are supplied to water atomizer nozzle 36 via hoses 37 and 39, respectively from a supply (not shown).

Figure 2:
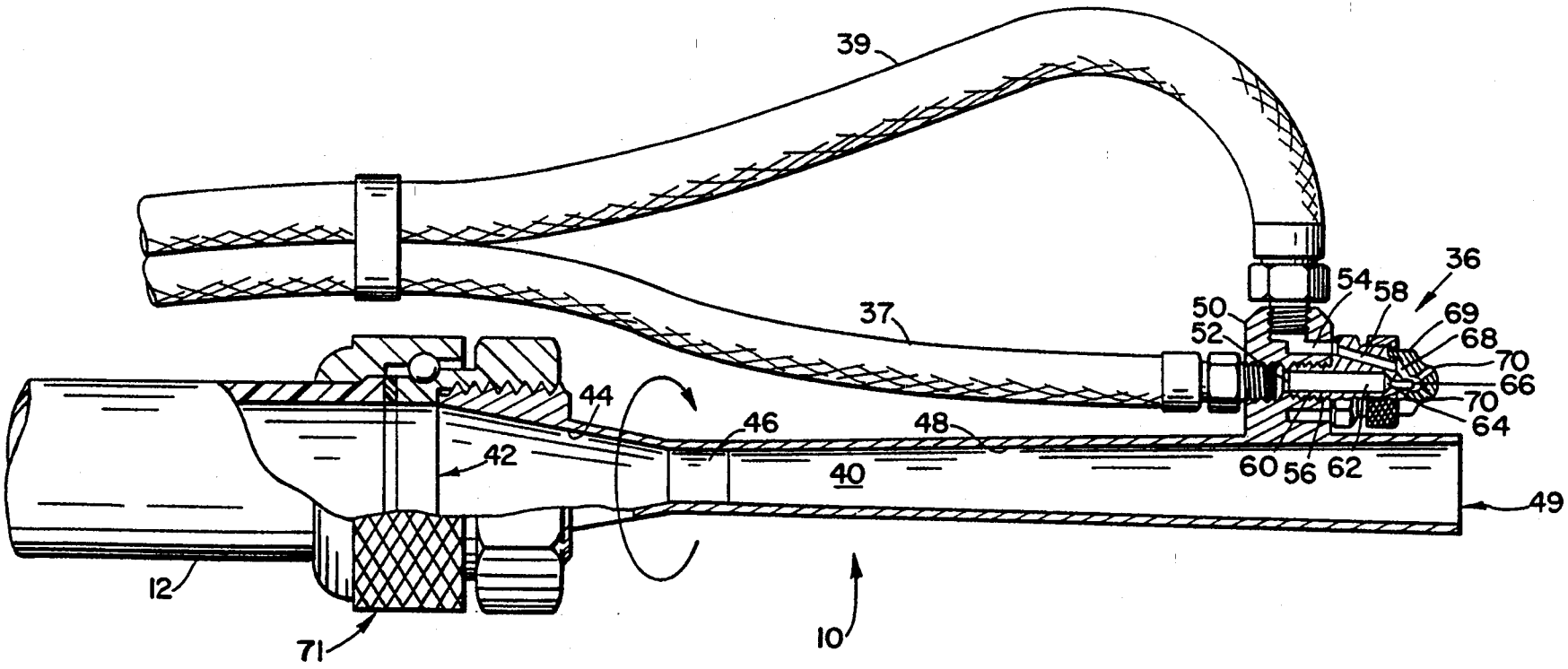
FIG. 2 is a cross sectional view of the blast nozzle of the present invention including the externally attached water atomizer nozzle.

FIG. 2 illustrates the improved blast nozzle of this invention. As shown therein, the abrasive blast system includes a blast nozzle 10 exemplified by a standard round nozzle containing a bore 40 formed therein defining a longitudinal axis. Bore 40 includes an inlet portion 42 which is part of converging surface 44, a throat 46 and a diverging surface 48 which includes outlet 49. The venturi effect formed by the juxtaposed surfaces 44, 48 and throat 46 serves to increase the velocity of the blast media out of outlet 49 of blast nozzle 10 to an extremely high velocity effective to clean or remove adhered coatings, scale, etc. from the surface being targeted. For protection against the eroding effects of the blast media, on the interior surfaces of the blast nozzle protective inserts or coatings may be advantageously provided on surfaces 44 and 48 and within throat area 46. Such coatings or inserts may advantageously comprise ceramics such as tungsten carbide or silicon nitride as erosion resistant materials. Tempered steel may also be used to form the blast nozzle.

To suppress the formation of dust or to at least control the dust cloud which forms upon the abrasive blast media contacting and then stripping or cleaning the solid surface, there is provided on the blast nozzle 10 of the present invention a water atomizer nozzle 36. Water atomizer nozzle 36 includes a nozzle support body 50 which is machined, cast or otherwise molded with blast nozzle 10 or formed separately and welded to the exterior of blast nozzle 10 near the outlet thereof. The nozzle support body 50 includes a water inlet port 52 and a separate inlet port. 54 for pressurized air. A nozzle atomizer tip 58 is threaded into the nozzle support body 50 and can be interchanged to accommodate various blast media as will be further explained below. Threads 60 of atomizer tip 58 mesh with female threads 56 contained in nozzle support body 50 so as to attach the nozzle atomizer tip 58 to blast nozzle 10. Inlet bore 62 in nozzle atomizer tip 58 is contiguous with and forms a continuous bore with water inlet port 52. Water supplied by hose 37 to inlet port 52 passes through inlet bore 62 and is increased in velocity through venturi 64 and directed into mixing chamber 66 contained in nozzle atomizer tip 58. Nozzle atomizer tip 58 further includes inlet air passage 68 which communicates with air inlet port 54 contained in nozzle support body 50. Air inlet 68 also communicates with mixing chamber 66. Thus, water entering mixing chamber 66 is mixed with the air entering chamber 66 through air passage 68. The air/water mixture leaves the nozzle atomizer tip 58 under pressure through exit ports 70 contained in atomizing cap 69 to form an atomized water spray which is directed at the deflecting abrasive blast media as shown in FIG. 1 so as to suppress dust formation and the formation of a dust cloud. Nozzle atomizer tip 58 and atomizing cap 69 are interchangeable structures and can be changed to another configuration so as to adjust for differing types of blast media being used or varying blasting conditions. For example, an atomizing cap 69 can be used which is configured with one or more, preferably, a plurality of exit ports 70 so as to produce a mist of the atomized water droplets directed at the targeted surface to suppress dust. Changing atomizing cap 69 to a different configuration can change the atomized cloud pattern to accommodate for changing process conditions. The structure of nozzle atomizer nozzle 36, per se, does not form part of the invention and can be provided from any number of commercial suppliers of atomizing nozzles. A particular useful nozzle tip is manufactured by Bete Fog Nozzle Inc., Greenfield, Mass. and provided from their ¼ XA Series of atomizer nozzles. Thus, atomizer nozzles which have different means to atomize water relative to the above described structure can be used so long as the proper droplet size can be formed. For example, it has been found that nozzles which externally mix the air and water can provide useful flat triangular atomized water clouds to control dust during blasting, particularly on large flat surfaces, i.e., rail cars, large tanks, etc.

To control dust formation during the blasting operation, it is important that the water atomizer nozzle 36 be directed at the deflection point of the media from the targeted surface. As the operator moves the blast nozzle relative to the targeted surface to fully clean or strip same of the dirt or coating, it is likely there will be instances in which the water atomizer nozzle is not pointed in the proper direction. The supply hose 12 which feeds the blast nozzle 10 with the air and blast media mixture is made of a very thick and stiff rubber in order to withstand the abrasive action of the media passing therethrough. Consequently, the supply hose cannot be readily twisted and turned to orient the blast nozzle 10 in a direction such that the water atomizer nozzle 36 is directed at the proper deflection point of the media from the targeted surface. Accordingly, it is preferable to include a swivel joint 71 to connect blast nozzle 10 to the supply hose 12 and allow the blast nozzle 10 to be rotated around the longitudinal axis of the supply hose so as to properly orient the water atomizer nozzle 36 at all times during blasting to control dust formation. The type of swivel joint 71, per se, is not part of the invention and any commercial swivel joint can be utilized. It is important that the swivel joint provide a substantially unrestricted passage between the supply hose and the blast nozzle so as to not adversely affect the flow of blast media therethrough and to maintain a homogenous concentration of the blast media throughout the air stream and the total cross sectional area of the inlet of blast nozzle 10. Thus, all joints should preferably butt together to provide an interior passage which is uniform and does not include gaps which can yield eddys and turbulent flow of the air and blast media through the hose and blast nozzle. An example of a commercial swivel joint which has been utilized with the blast nozzle of the present invention is one manufactured by OPW Engineered Systems, Mason, Ohio, Aluminum Model 25 with a 1¼ inch bore. Alternatively, it is also possible to maintain blast nozzle 10 at a fixed position relative to the supply hose 12 and have atomizer nozzle 36 positioned so as to swivel about the longitudinal axis of the blast nozzle. An advantage of this arrangement is the ability to minimize the contamination of the swivel by the blast media.

In order to control the dust formation, it is important that the water droplets from the water atomizer nozzle 36 have the proper size. Thus, water atomizer nozzles producing water particles of 200 microns at most, typically 50 microns to submicron particle size are useful. The particle size of the water droplet to be used will depend upon the type of media utilized, the size of the media particles as well as the size of the media particles which are typically formed subsequent to contacting the targeted surface. Water droplets which have too great of size cannot attach and mix readily with the dust particles to suppress dust formation and precipitate the media particles from the air. Moreover, water droplet sizes which are too large interfere with the blast media particles in the blast stream prior to substrate impact. This interaction reduces the velocity of the media particles and consequently decreases performance. On the other hand, if the water is atomized to a particle size which is too minute, the water particles are not sufficiently dense enough to precipitate the dust particles and may exacerbate the formation of the dust cloud by simply forming an additional fog adjacent the targeted surface. Droplet size can be controlled by a variety of factors. The relative amount of water and air introduced into the water atomizer nozzle can be used to control the water droplet size. Thus, water pressures of 10 to 300 psi and flow of at least 0.02 to about 1.0 gallon per min. and air pressures of 10 to 300 psi and flows of greater than 10 CFM have been found useful to produce atomized water droplets of appropriate size especially to reduce sodium bicarbonate dust. An excessive air pressure can create a water fog in which the atomized water droplets are simply not large enough to yield precipitation and control of the dust which forms adjacent the targeted surface. It has been found, for example, that a water pressure of 50 psi and an air pressure of 35 psi in which the water passes through the water atomization nozzle at 0.15 gallon per minute is most useful to suppress dust from sodium bicarbonate having a size of 200 microns before impact with the targeted surface. It has also been found that slight variations in the water and air pressure do not substantially affect the productivity of the stripping action. Thus, water droplet size can be controlled without adversely affecting productivity. Moreover, as stated previously, different atomizer configurations can be used to provide the necessary droplet sizes.

Unlike the prior art dust control methods where a water stream is either injected internally into the blast nozzle or sprayed from a nozzle external of the blast nozzle onto the targeted surface, the water atomization nozzle of the present invention does not substantially reduce performance or, in other words, adversely effect the stripping action of the blast media. This has been found particularly true for the sodium bicarbonate blast media which is water soluble and less dense than sand and can be greatly decelerated by the addition of the prior art water sprays. The deceleration of the blast media particles toward the targeted surface greatly reduces the production and stripping action of the blast media. Thus, unlike the present invention, the atomized water spray is sufficient to effectively control the dust and the water droplets formed are of such a small size that they do not adversely affect the blast media leaving the blast nozzle and directed toward the targeted surface. Moreover, the direction of the atomized water toward the deflected dust and not into the blast media stream also is advantageous in minimizing interaction between the two steams and, thus, maintaining good productivity of the blast media.

Figure 3:
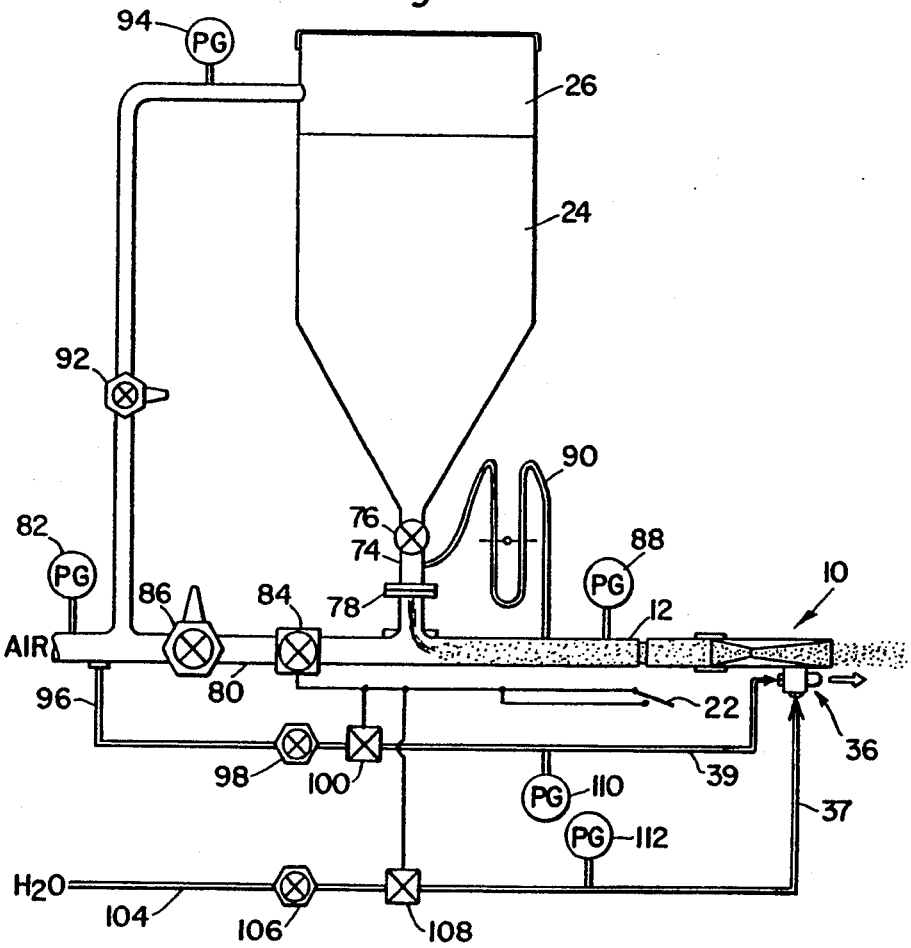
FIG. 3 is a schematic representation of the abrasive blast cleaning system of the present invention which includes a blast nozzle and a pressurized air stream for propelling the blast media to the targeted surface and the water atomizer nozzle for controlling dust.

The system operation of the blast nozzle of the present invention is shown in FIG. 3. Referring to FIG. 3, the blast system includes blast pot 26 partially filled with blast media 24. The blast pot 26 suitably having a cavity of about 6 cubic feet, terminates in a media exit line 74 governed by a valve 76. The medium control area, typically but not limited to an orifice plate 78, further restricts the flow of the media 24 to the desired flow rate. A line 80 is connected to a source of pressurized air (not shown) which is monitored with an inlet monitor 82. Air valve 84 is a remotely operated on/off valve that activates the air flow to the nozzle and the opening and closing of the media cut off valve. Nozzle pressure regulator valve 86 regulates the nozzle pressure by means of a monitor 88 when the system is in operation. Nozzle pressure regulator valve 86 can maintain the desired nozzle pressure. The nozzle pressure monitor 813 enables a controlled pressure to be applied to the nozzle 10. The differential pressure gauge 90 monitors the pressure between the blast pot 26 and the supply hose 12. The pot pressure regulator 92, measured by gauge 94, is used to provide a pressure higher than the pressure in the conveying hose 12, thus allowing the differential pressure to be monitored by differential pressure gauge 90.

In operation, the blast media 24 is fed through media exit line 74 and the valve 76 to an orifice plate 78, which regulates the flow of media to the compressed air line 80. The orifice openings can vary from about 0.063 to about 0.156 inch diameter, or openings corresponding to the area provided by circular orifices of 0.063 to 0.156 inch diameter. Preferably, the openings correspond to about a 0.125 inch opening for sodium bicarbonate media having a mean particle size of about 70 microns, and 0.156 inch opening for a media having a mean particle size from about 250 to about 300 microns. A positive pressure of between about 1 to 5 psig preferably about 2 to 4 psig between the media exit line 74 and the conveying hose 12 is maintained at all times. A source of compressed air is also fed to the air line 80, regulated by the valves 84 and 86 to the desired air pressure and nozzle pressure, respectively, which preferably is between about 30 to about 150 psi. The pot pressure regulator 92 controls the pressure to the top of the blast pot 26, further ensuring a controlled and uniform flow of blast media 24. The manometer or other differential pressure gauge 90 measures the differential pressure, which is proportional to the amount of media flowing through the orifice 78. The blast media and compressed air are delivered to the nozzle 10 and ejected toward the workpiece at a uniform and controllable rate.

The operation of the water atomizer nozzle 36 is similar to that described for the blast nozzle 10 above. Thus, air typically from the same supply which feeds blast nozzle 10 is directed through line 96 and the pressure thereof controlled by pressure regulator 98. Hose 39 directs the pressurized air to the appropriate air inlet port in the nozzle body of the water atomizer 36 as described above. Valve 100 is a on/off valve which is activated by the spring loaded deadman valve 22 which is controlled by the operator. Water for the water atomizer nozzle 36 is directed from a supply (not shown) and passed through line 104. The pressure is controlled by pressure regulator valve 106. Water through hose 37 is passed to the water inlet port of the nozzle body of water atomizer 36. On/off valve 108 again is controlled by deadman switch 22. Pressure gauges 110 and 112 indicate to the users the pressures in lines 96 and 104, respectively. All of the on/off valves 84, 100 and 108 are controlled by the operator through the deadman switch 22 and, thus, all flow of air, abrasive media and water to blast nozzle 10 and the water atomizer nozzle 36 can be activated and cut off by the spring activated switch which is typically in the form of a hand-held trigger adjacent the blast nozzle.

The blast nozzle containing the water atomizer nozzle of the present invention can be advantageously used with any type of friable blast media. Thus, while it has been disclosed that the blast nozzle of the present invention is most useful with soft friable blast media such as sodium bicarbonate, the blast nozzle apparatus is also useful with hard friable blast media such as sand. Thus, the blast nozzle apparatus is useful to control the silica dust which results upon blasting with sand. Moreover, the blast nozzle apparatus of this invention is useful to remove coatings, scale and the like from any type of surface including the softer surfaces described above such as soft metals including aluminum and plastic surfaces and, as well, hard surfaces such as hard metals including steel. Moreover, the particular configuration of the blast nozzle, per se, can be changed without adversely affecting the improvements found with the water atomizer nozzle to control dust. Thus, although the standard round nozzle is disclosed and illustrated in the accompanying figures, it is to be well understood that other configurations of blast nozzle can be used with equal advantage.

The following examples are provided for the purpose of illustrating the invention only and are not to be so construed as to limit the appended claims solely to the embodiments described in these examples.

EXAMPLE 1

Sodium bicarbonate blast media having an average diameter of about 200 microns was utilized to strip an epoxy paint coated on steel at a thickness of about 12 to 14 mils. The amount of paint stripped defined as mil square feet per minute of paint removed relative to the flow rate of the sodium bicarbonate in pounds per minute was measured and compared using various types of blast nozzles in which the sodium bicarbonate was dry blasted or wet blasted in which the water stream at 200 psi was injected into the media/air stream internally in the blast nozzle or into the media/air stream externally of the blast nozzle. Two blast nozzles containing the water atomizer of this invention were also tested.

The blast nozzles utilized were standard round nozzles each having a two inch long inlet, a 0.5 inch diameter throat, a 0.75 inch diameter outlet and a total length as designated in the key below. Air pressure for carrying the media was 60 psi. The water and air pressure for dust control using the two water atomizer nozzles of this invention are also set forth in the key below.

MOD DRY —Dry blasting —nozzle length 8 in.
DRY —Dry blasting —nozzle length 6 in.
WET —External $H_2O$ nozzle length 6 in.
STD WET —Internal $H_2O$ nozzle length 8 in.
ATOMIZED $H_2O$ —Atomized $H_2O$ (50 psi $H_2O$/35 psi air) with blast nozzle length 8 in.
MOD ATOMIZED $H_2O$ —Atomized $H_2O$ (40 psi $H_2O$/80 psi air) with blast nozzle length 12 in.

Figure 4:
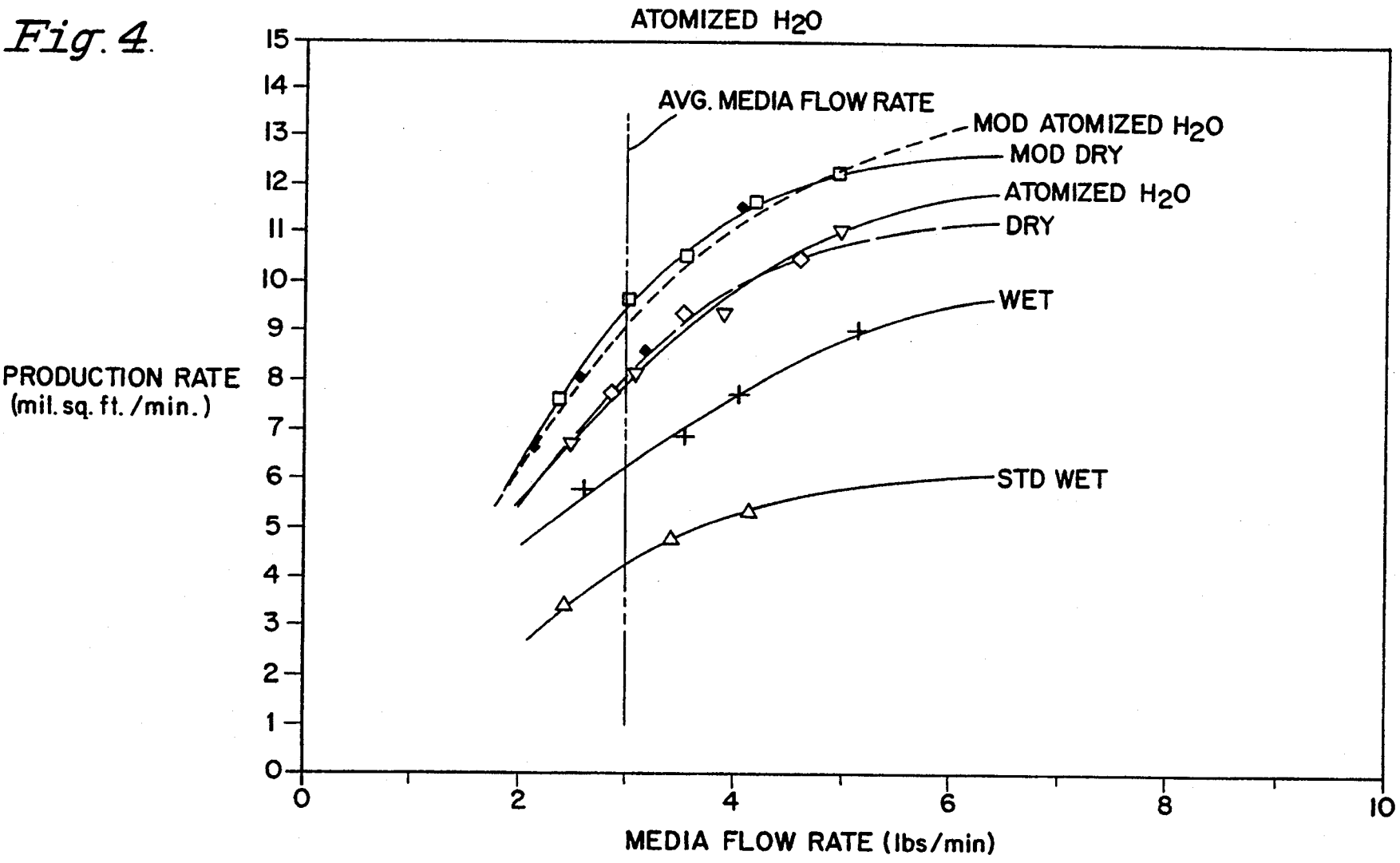
FIG. 4 is a graph comparing the productivity of the blast nozzle of the present invention with prior art abrasive blast cleaning systems.

Referring to FIG. 4, it can be seen that dry blasting with sodium bicarbonate using the longer blast nozzle (MOD DRY) yielded excellent productivity with regard to the stripping rate of the paint sample. Unfortunately, although it was not quantified, a substantial amount of dust was formed during dry blasting. The standard wet nozzle in which a stream of water of about 200 psi was injected internally in the MOD DRY blast nozzle to mix with the air stream yielded a productivity which was substantially reduced with respect to the productivity found with the dry blasting using the MOD DRY nozzle. Dust control was excellent, however. It would be useful to combine the productivity of dry blasting with the dust control of wet blasting without substantially sacrificing the productivity. It was attempted to modify the dry blasting by providing an external source of water directed at the targeted surface. The productivity rate of this blast nozzle indicated by the curve "WET" as shown in FIG. 4 was substantially below the equivalent dry blasting nozzle indicated by the curve "DRY" but substantially improved relative to blasting with the internal water flow. However, dust control was minimal and, thus, both dust control and productivity were sacrificed. However, when utilizing the atomized water flow of the present invention "ATOMIZED $H_2O$", very good dust control was observed and, at the same time, productivity was substantially the same if not better than the dry blasting utilizing the shorter nozzle "DRY". Relative to the same dry blasting "MOD DRY" nozzle, productivity was slightly sacrificed although greatly improved over both the comparative wet blasting techniques utilized.

An interesting observation which can be ascertained from FIG. 4 is that lengthening the nozzle outlet substantially improved productivity relative to the stripping rate. This can be seen by comparing the dry blasting productivity obtained from using the MOD DRY nozzle with the DRY nozzle which was approximately 2 inches shorter than the MOD DRY nozzle. As can be seen from FIG. 4, there was an improvement in the stripping rate using the longer nozzle. Likewise, the MOD ATOMIZED $H_2O$ nozzle which had a nozzle length 4 inches greater than the MOD DRY nozzle yielded an equivalent productivity. Thus, the blast nozzle of the present invention which contains a water atomizer to control dust not only provides improved dust control but at the same time provides a production rate substantially equivalent to dry blasting. Although the MOD ATOMIZED $H_2O$ nozzle used water and air pressures in the water atomizer which were not the same as those used for the ATOMIZED $H_2O$ nozzle, it will be seen below in Example 2 that changes in the water and air pressure have little effect on the production rate especially at media flow rates ranging from 3 to 5 lbs. per minute.

It has been suggested previously that by increasing the length of the nozzle, productivity can be increased at least with respect to blasting with sand. Unfortunately, the blasting nozzles used for propelling sand against a targeted surface must be formed of very heavy ceramic material to withstand the abrasive nature of the sand. Longer nozzles simply are not practical since by lengthening the nozzle, the weight of the nozzle is greatly increased making hand-held operation of such nozzles extremely difficult. Using a lighter sodium bicarbonate blast media, however, allows the use of substantially lighter materials of construction to form the blast nozzle. For example, very thin stainless steel can be used to form the blast nozzle. The blast nozzle now can be lengthened without adding excessive weight thereto and, thus, hand-held operation is practical and a substantially improved productivity whether dry blasting or utilizing the atomized water blasting of the present invention is provided. It has been found that in those blast nozzles comprising a converging inlet, a venturi throat and a diverging outlet wherein the total length of the blast nozzle is at least about four times, preferably at least five times and, more preferably, at least about six times the length of the inlet substantially improved productivity rates of blasting with sodium bicarbonate are provided and this has been found whether during dry blasting or utilizing the dry blasting with atomized water for dust control. This productivity increase using the longer blast nozzles for blasting with sodium bicarbonate also forms a part of the present invention.

EXAMPLE 2

Figure 5:
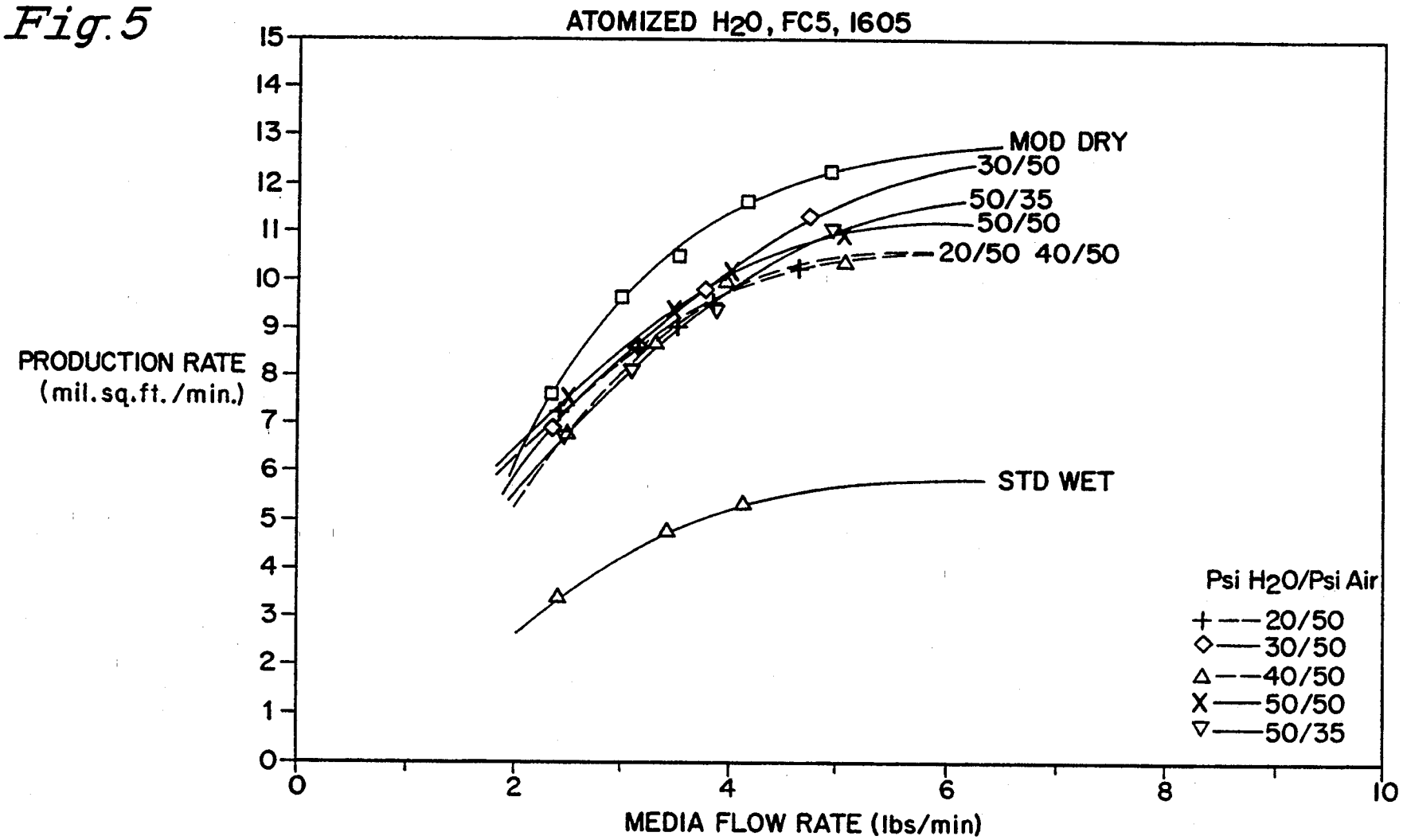
FIG. 5 is a graph comparing the production rates utilizing the blast nozzle of the present invention including water atomizer nozzle in which the water and air pressures to the water atomizer nozzle were varied.

In this example, the air and water pressure to the atomized water nozzle for dust control was varied in order to determine if differences in productivity would result. The results are shown in FIG. 5 in which the productivity of the standard wet nozzle and the modified dry nozzle as in Example 1 have been added for comparison. The samples stripped were the same as used in Example 1.

As can be seen from FIG. 5, there was not a substantial difference in productivity especially at the lower media flow rates for each of the atomized water nozzles of the present invention. Thus, there is a latitude to adjust the droplet size of the atomized water for dust control by controlling the water and air pressure so as to take into account the type and size of blast media utilized without sacrificing the productivity of the nozzle.

What is claimed is:

1. A process for removing contaminants from the surface of a solid substrate comprising; directing at said substrate a stream of abrasive friable sodium bicarbonate particles capable of stripping said contaminants from said surface upon contact therewith, said sodium bicarbonate particles being directed at said substrate by means of a blast nozzle comprising a hollow converging inlet portion, a downstream hollow diverging outlet portion and a venturi orifice placed intermediate of said converging and diverging portions wherein the total length of said blast nozzle is at least four times the length of said hollow converging inlet portion, forming a separate stream of atomized water droplets by atomizing water with compressed air and directing said separate stream of atomized water droplets to said solid surface to suppress dust formation as said abrasive friable sodium bicarbonate particles contact said solid surface.

2. The process of claim 1 wherein said stream of atomized water droplets are formed externally relative to said blast nozzle and do not substantially interfere with the flow of sodium bicarbonate particles from said blast nozzle to said solid substrate.

3. The process of claim 1 wherein said abrasive friable particles are directed to said surface in a compressed air stream having a pressure of 10 to 150 psi.

4. The process of claim 1 wherein said atomized water droplets are formed by mixing water at a pressure of 10 to 300 psi with air at a pressure of 10 to 300 psi.

5. The process of claim 1 wherein said atomized water droplets have a maximum size of about 200 microns.

6. The process of claim 1 wherein said sodium bicarbonate has an average diameter of 30 to 1,000 microns.

7. The process of claim 1 wherein said atomized water stream is directed at said substrate at a location to meet the deflecting abrasive particles subsequent to contact with said solid surface.

8. The process of claim 1 wherein said solid substrate is aluminum.

9. The process of claim 1 wherein said solid substrate is non-metallic.

10. The process of claim 1 wherein said abrasive friable particles are water-soluble.

11. The process of claim 1 wherein the length of said blast nozzle is at least about five times the length of said hollow converging inlet portion.

12. The process of claim 1 wherein the length of said blast nozzle is at least about six times the length of said hollow converging inlet portion.

* * * * *